US011066217B2

(12) United States Patent
Pinelli et al.

(10) Patent No.: US 11,066,217 B2
(45) Date of Patent: Jul. 20, 2021

(54) TWIST LID FOR BEVERAGE CONTAINER

(71) Applicant: Leapfrog Product Development LLC, Chicago, IL (US)

(72) Inventors: Steven N. Pinelli, Ogden Dunes, IN (US); Jaswanth Chowdary Gonuguntla, Anantapur (IN); Richard E. Ellison, Chicago, IL (US); Kurtis M. Sward, Anna Maria, FL (US); Micaela K. McCabe, Chicago, IL (US); Glen C. Gilmore, III, Naperville, IL (US); Brian M. Clemens, Burnsville, MN (US)

(73) Assignee: Leapfrog Product Development LLC, Chicago, IL (US)

( * ) Notice: Subject to any disclaimer, the term of this patent is extended or adjusted under 35 U.S.C. 154(b) by 192 days.

(21) Appl. No.: 16/441,262

(22) Filed: Jun. 14, 2019

(65) Prior Publication Data

US 2020/0391909 A1 Dec. 17, 2020

(51) Int. Cl.

| | |
|---|---|
| ***B65D 47/08*** | (2006.01) |
| ***B65D 55/10*** | (2006.01) |
| ***A45F 3/18*** | (2006.01) |
| ***B65D 51/18*** | (2006.01) |
| ***B65D 43/02*** | (2006.01) |
| ***B65D 53/02*** | (2006.01) |

(52) U.S. Cl.

CPC ..... *B65D 47/0871* (2013.01); *A45F 3/18* (2013.01); *B65D 43/0231* (2013.01); *B65D 51/18* (2013.01); *B65D 53/02* (2013.01); *B65D 55/10* (2013.01); *B65D 2251/0025* (2013.01); *B65D 2251/0081* (2013.01); *B65D 2251/1058* (2013.01)

(58) Field of Classification Search

CPC ..... B65D 47/08; B65D 47/0871; B65D 47/0804; B65D 47/0809; B65D 47/0814; B65D 47/0828; B65D 47/0833; B65D 47/0838; B65D 47/0842; B65D 50/06; B65D 50/065; A45F 3/18

See application file for complete search history.

(56) References Cited

U.S. PATENT DOCUMENTS 3,578,192 A * 5/1971 Sonne ..... B65D 50/067 215/221
3,773,203 A * 11/1973 Grimaldi ..... B65D 47/0838 215/223

(Continued)

OTHER PUBLICATIONS

Zulu, "Atlas20 oz Glass Water Bottle," accessed on-line at: https://www.zuluathletic.com/shop-all/atlas-glass-water-bottle (available at least as early as Jun. 14, 2019).

(Continued)

*Primary Examiner* — Andrew T Kirsch
(74) *Attorney, Agent, or Firm* — Barnes & Thornburg LLP

(57) ABSTRACT

A lid for a beverage container includes a lid cover, a lid base and a twist ring. The twist ring is rotationally secured to the lid base. The lid cover has a first latch member, the lid base has a first mating member, and the twist ring has a second latch member that mates with the first latch member and a second mating member that mates with the first mating member to allow the twist ring to rotate with respect to the lid base to disengage the second latch member from the first latch member.

20 Claims, 11 Drawing Sheets

(56) References Cited

U.S. PATENT DOCUMENTS

| | | | |
|---|---|---|---|
| D364,810 | S | 12/1995 | Meisner |
| D471,455 | S | 3/2003 | Laveault et al. |
| D485,132 | S | 1/2004 | Ohno et al. |
| D505,294 | S | 5/2005 | Gauss |
| D508,185 | S | 8/2005 | Gauss |
| D515,357 | S | 2/2006 | Ward et al. |
| D528,862 | S | 9/2006 | Li |
| D533,061 | S | 12/2006 | Li |
| D564,841 | S | 3/2008 | Clemens et al. |
| D579,722 | S | 11/2008 | Sakulsacha et al. |
| D581,727 | S | 12/2008 | Pinelli et al. |
| D592,456 | S | 5/2009 | Pinelli et al. |
| D592,905 | S | 5/2009 | Pinelli et al. |
| D592,913 | S | 5/2009 | Pinelli et al. |
| 7,546,933 | B2 | 6/2009 | Pinelli |
| D609,964 | S | 2/2010 | Lane |
| D643,249 | S | 8/2011 | Miller et al. |
| 7,997,442 | B2 | 8/2011 | Pinelli |
| D655,580 | S | 3/2012 | Kotani |
| D656,787 | S | 4/2012 | Phillips et al. |
| D661,945 | S | 6/2012 | Eyal |
| D675,060 | S | 1/2013 | Lane |
| 8,360,267 | B1 | 1/2013 | Chiou et al. |
| D686,871 | S | 7/2013 | Lane |
| D693,629 | S | 11/2013 | Miller |
| D693,630 | S | 11/2013 | Hurley et al. |
| 8,579,133 | B2 | 11/2013 | Marcus et al. |
| 8,590,731 | B2 | 11/2013 | Pinelli |
| D700,012 | S | 2/2014 | Hurley et al. |
| D700,802 | S | 3/2014 | Miller |
| 8,978,906 | B2 | 3/2015 | Feeley et al. |
| D725,966 | S | 4/2015 | Boroski et al. |
| D739,183 | S | 9/2015 | Lane |
| 9,266,643 | B2 | 2/2016 | Marcus et al. |
| D758,189 | S | 6/2016 | Roth et al. |
| D758,790 | S | 6/2016 | Boroski |
| D780,578 | S | 3/2017 | Lane et al. |
| D785,402 | S | 5/2017 | Shirley et al. |
| D793,804 | S | 8/2017 | Herbst et al. |
| D794,453 | S | 8/2017 | Boroski et al. |
| D795,011 | S | 8/2017 | Pisarevsky |
| D799,898 | S | 10/2017 | Yao |
| D802,993 | S | 11/2017 | Joseph et al. |
| D804,903 | S | 12/2017 | Mason et al. |
| D804,904 | S | 12/2017 | Noveletsky et al. |
| D808,220 | S | 1/2018 | Bums et al. |
| D809,384 | S | 2/2018 | Best et al. |
| D814,398 | S | 4/2018 | Yasunaga |
| D817,713 | S | 5/2018 | Lin |
| D818,767 | S | 5/2018 | Nezu |
| D821,136 | S | 6/2018 | Silsby et al. |
| D821,137 | S | 6/2018 | Boroski |
| D821,815 | S | 7/2018 | Chung |
| D822,427 | S | 7/2018 | Sorensen et al. |
| D831,425 | S | 10/2018 | Best et al. |
| D831,433 | S | 10/2018 | Fleischhut |
| D835,939 | S | 12/2018 | Yee et al. |
| D839,044 | S | 1/2019 | Potter et al. |
| D848,787 | S | 5/2019 | Tatsukawa et al. |
| D853,181 | S | 7/2019 | Stanton |
| D853,784 | S | 7/2019 | Wu |
| D865,457 | S | 11/2019 | Kotani |
| D869,230 | S | 12/2019 | Hao |
| D870,509 | S | 12/2019 | Bo |
| 2011/0089059 | A1 | 4/2011 | Lane et al. |
| 2012/0312832 | A1 | 12/2012 | Lane |
| 2014/0339177 | A1 | 11/2014 | Lane |
| 2015/0282654 | A1 | 10/2015 | Kurabe et al. |
| 2017/0297785 | A1 | 10/2017 | Maruyama et al. |

OTHER PUBLICATIONS

Kor, "Vida Bottle—25oz," accessed on-line at: https://waterbottles.com/kor-vida-bottle-25-oz (available at least as early as Jun. 14, 2019).

Thermos, "Hydration Bottle with Rotating Intake Meter, 24oz," accessed on-line at: https://www.thermos.com/genuine-thermos-brand-hydration-bottle-with-rotating-intake-meter-24oz.html (available at least as early as Jun. 14, 2019).

Thermos, "Shaker Bottle with Integrated Mixer, 24oz," accessed on-line at: https://www.thermos.com/genuine-thermos-brand-shaker-bottle-with-integrated-mixer-24oz-clear-green-accents.html (available at least as early as Jun. 14, 2019).

Tervis, "Custom Water Bottle," accessed on-line at: https://www.tervis.com/turtle-sunset-stainless-steel-24oz-stainless-water-bottle-1362572.html (available at least as early as Jun. 14, 2019).

Swell, "Bottles," accessed on-line at: https://www.swell.com/shop/swell/bottles/ (available at least as early as Jun. 14, 2019).

Tritan, "32 oz Soft Straw Plastic Water Bottle," accessed on-line at: http://www.pogogear.com/32oz-tritan-straw (available at least as early as Jun. 14, 2019).

Tritan, "32oz Chug Plastic Water Bottle," accessed on-line at: http://www.pogogear.com/32oz-tritan-chug (available at least as early as Jun. 14, 2019).

Tritan, "18oz Chug Plastic Water Bottle," accessed on-line at: http://www.pogogear.com/18oz-tritan-chug (available at least as early as Jun. 14, 2019).

Ello, "chi 24oz BPA-Free Tritan Plastic Water Bottle," accessed on-line at: https://www.elloproducts.com/water-bottles/chi-24oz-plastic-water-bottle (available at least as early as Jun. 14, 2019).

Ello, "Dash 16oz 2pk Tritan Plastic Water Bottles," accessed on-line at: https://www.elloproducts.com/kids/dash-16oz-tritan-plastic-water-bottle (available at least as early as Jun. 14, 2019).

Ello, "Cru Stemless Wine glass Set with Silicone Protection," accessed on-line at: https://www.elloproducts.com/tumblers/cru-stemless-wine-glass-set-with-silicone-protection (available at least as early as Jun. 14, 2019).

Aladdin, "Water Bottle," (1 page) (available at least as early as Jun. 14, 2019).

Ello, "Elsie 22oz Glass Water Bottle," accessed on-line at: https://www.elloproducts.com/water-bottles/elsie-22oz-glass-water-bottle (available at least as early as Jun. 14, 2019).

Ello, "Beacon 24oz Vacuum Insulated Stainless Tumbler," accessed on-line at: https://www.elloproducts.com/tumblers/beacon-24oz-vacuum-insulated-stainless-tumbler (available at least as early as Jun. 14, 2019).

Ello, "Rise 12oz Vacuum Insulated Stainless Steel Tumbler with Optional Straw," accessed on-line at: https://www.elloproducts.com/kids/rise-12oz-vacuum-insulated-stainless-steel-tumbler(available at least as early as Jun. 14, 2019).

Ello, "Hammertime 18oz Stainless Steel Travel Mug," accessed on-line at: https://www.elloproducts.com/travel-mugs/hammertime-18oz-vacuum-insulated-stainless-steel-travel-mug (available at least as early as Jun. 14, 2019).

Ello, "Pure 20oz Glass Water Bottle," accessed on-line at: https://www.elloproducts.com/water-bottles/pure-20oz-glass-water-bottle (available at least as early as Jun. 14, 2019).

Ello, "Max 12oz Vacuum-Insulated Stainless Steel Kids Water Bottle," accessed on-line at: https://www.elloproducts.com/kids/max-12oz-vacuum-insulated-stainless-steel-kids-water-bottle (available at least as early as Jun. 14, 2019).

Ello, "Syndicate 20oz Glass Water Bottle," accessed on-line at: https://www.elloproducts.com/water-bottles/syndicate-20oz-glass-water-bottle (available at least as early as Jun. 14, 2019).

Mason, "Glass Jar," (1 page) (available at least as early as Jun. 14, 2019).

Camelbak, "Eddy+ 1L Bottle," accessed on-line at: https://www.camelbak.com/en/bottles/R02056--Eddy_75L_2019?color=6bbd0584f3a64b0eb30d406f7e03797e (available at least as early as Jun. 14, 2019).

(56) References Cited

OTHER PUBLICATIONS

Contigo, "Autoseal West Loop 2.0 Stainless," accessed on-line at: https://www.gocontigo.com/20-oz-autoseal-west-loop-stainless-travel-mug-with-easy-clean-lid.html (available at least as early as Jun. 14, 2019).
Contigo, "Autospout Straw Striker Chill," accessed on-line at: https://www.gocontigo.com/14-oz-autospout-striker-kids-water-bottle.html (available at least as early as Jun. 14, 2019).
Zojirushi, "Travel Mug SM-YAE48," accessed on-line at: https://www.zojirushi.com/app/product/smyae (available at least as early as Jun. 14, 2019).
Zojirushi, "Stainless Mug SM-KC3648," accessed on-line at: https://www.zojirushi.com/app/product/smkc (available at least as early as Jun. 14, 2019).
Zojirushi, "Stainless Bottle SJ-JS10," accessed on-lien at: https://www.zojirushi.com/app/product/sjjs (available at least as early as Jun. 14, 2019).
Zojirushi, "Flip-and-Go Stainless Mug SM-QHE48/60," accessed on-line at: https://www.zojirushi.com/app/product/smqhe (available at least as early as Jun. 14, 2019).
Zojirushi, "Stainless Mug SM-TAE48SA, Ichimatsu Collection," accessed on-line at: https://www.zojirushi.com/app/product/smtae (available at least as early as Jun. 14, 2019).
Zojirushi, "Stainless Mug SM-TA36/48/60," accessed on-line at: https://www.zojirushi.com/app/product/smta (available at least as early as Jun. 14, 2019).
Zojirushi, "Stainless Mug SM-SE36/48/60," accessed on-line at: https://www.zojirushi.com/app/product/smse (available at least as early as Jun. 14, 2019).
Zojirushi, "Stainless Mug SM-SD36/48/60," accessed on-line at: https://www.zojirushi.com/app/product/smsd (available at least as early as Jun. 14, 2019).
Zojirushi, "Stainless Mug SM-SHE48160," accessed on-line at: https://www.zojirushi.com/app/product/smshe (available at least as early as Jun. 14, 2019).
Zojirushi, "Stainless Mug SM-KHE36148," accessed on-line at: https://www.zojirushi.com/app/product/smkhe (available at least as early as Jun. 14, 2019).
Zojirushi, "Stainless Mug SM-SC36/48/60" accessed on-line at: https://www.zojirushi.com/app/product/smsc (available at least as early as Jun. 14, 2019).
Zojirushi, "Stainless Mug SM-PC20/30," accessed on-line at: https://www.zojirushi.com/app/product/smpc (available at least as early as Jun. 14, 2019).
Zojirushi, "Stainless Mug SM-PB30/34," accessed on-line at: https://www.zojirushi.com/app/product/smpb(available at least as early as Jun. 14, 2019).
Migo, "Enjoy Sport Water Bottle," accessed on-line at: https://www.pinterest.ru/pin/12666442685646757/ (available at least as early as Jun. 14, 2019).
Coleman, "Switch SS," accessed on-line at: https://www.coleman.com/all-camp-kitchen/drinkware/switch-ss/col_2038485_pr/COL_2038485 (available at least as early as Jun. 14, 2019).
Corkcicle, "Classic Arctican," accessed on-line at: https://corkcicle.com/products/classic-arctican?variant=475182759951 (available at least as early as Jun. 14, 2019).
Ello, "Reflext Beverage Container," (1 page) (available at least as early as Jun. 14, 2019).
https://www.zuluathletic.com/shop-all/atlas-glass-water-bottle.
https://waterbottles.com/kor-vida-bottle-25-oz.
https://www.thermos.com/genuine-thermos-brand-hydration-bottle-with-rotating-intake-meter-24oz.html.
https://www.thermos.com/genuine-thermos-brand-shaker-bottle-with-integrated-mixer-24oz-clear-green-accents.html.
https://www.tervis.com/turtle-sunset-stainless-steel-24oz-stainless-water-bottle-1362572.html.
https://www.swell.com/shop/swell/bottles/.
http://www.pogogear.com/32oz-tritan-straw.
http://www.pogogear.com/32oz-tritan-chug.
http://www.pogogear.com/18oz-tritan-chug.
https://www.elloproducts.com/water-bottles/chi-24oz-plastic-water-bottle.
https://www.elloproducts.com/kids/dash-16oz-tritan-plastio-water-bottle.
https://www.elloproducts.com/tumblers/cru-stemless-wine-glass-set-with-silicone-protection.
Aladdin Water Bottle (1 page).
https://www.elloproducts.com/water-bottles/elsie-22oz-glass-water-bottle.
https://www.elloproducts.com/tumblers/beacon-24oz-vacuum-insulated-stainless-tumbler.
https://www.elloproducts.com/kids/rise-12oz-vacuum-insulated-stainless-steel-tumbler.
https://www.elloproducts.com/travel-mugs/hammertime-18oz-vacuum-insulated-stainless-steel-travel-mug.
https://www.elloproducts.com/water-bottles/pure-20oz-glass-water-bottle.
https://www.elloproducts.com/kids/max-12oz-vacuum-insulated-stainless-steel-kids-water-bottle.
https://www.elloproducts.com/water-bottles/syndicate-20oz-glass-water-bottle.
Mason Glass Jar (1 page).
https://www.camelbak.com/en/bottles/R02056-Eddy_75L_2019?color=6bbd0584f3a64b0eb30d406f7e03797e.
https://www.gocontigo.com/20-oz-autoseal-west-loop-stainless-travel-mug-with-easy-clean-lid.html.
https://www.gocontigo.com/14-oz-autospout-striker-kids-water-bottle.html.
https://www.zojirushi.com/app/product/smyae.
https://www.zojirushi.com/app/product/smkc.
https://www.zojirushi.com/app/product/sjjs.
https://www.zojirushi.com/app/product/smqhe.
https://www.zojirushi.com/app/product/smtae.
https://www.zojirushi.com/app/product/smta.
https://www.zojirushi.com/app/product/smse.
https://www.zojirushi.com/app/product/smsd.
https://www.zojirushi.com/app/product/smshe.
https://www.zojirushi.com/app/product/smkhe.
https://www.zojirushi.com/app/product/smsc.
https://www.zojirushi.com/app/product/smpc.
https://www.zojirushi.com/app/product/smpb.
https://www.pinterest.ru/pin/12666442685646757/.
https://www.coleman.com/all-camp-kitchen/drinkware/switch-ss/col_2038485pr/COL_2038485.
https://corkcicle.com/products/classic-arctican?variant=475182759951.
ELLO Reflext Beverage Container (1 page).

* cited by examiner

TWIST LID FOR BEVERAGE CONTAINER

FEDERALLY SPONSORED RESEARCH OR DEVELOPMENT

Not Applicable.

TECHNICAL FIELD

The present disclosure relates generally to lids for beverage containers, and more specifically to a unlatching mechanism for a lid closure.

BACKGROUND

Beverage containers and lids for beverage containers are well known in the art. While such beverage containers and lids according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology generally relates to an unlatching lid mechanism for a beverage container.

The disclosed subject technology further relates to a lid assembly for a beverage container, comprising: a lid cover having a first latch member; a lid base pivotally securing the lid cover, the lid base having a first mating member and a drink spout; a twist ring rotationally connected around a portion of the lid base, the twist ring having a second latch member that mates with the first latch member, the twist ring further having a second mating member that mates with the first mating member, wherein the twist ring is adapted to rotate with respect to the lid base and the lid cover; a damping member between a portion of the lid base and the twist ring, the damping member adapted to stop rotation of the twist ring and to bias the twist ring in an opposite direction; and, a lock operably connected to the lid base, the lock moving between a locked position and an unlocked position, the lock preventing rotation of the twist ring when the lock is in the locked position.

The disclosed subject technology further relates to a lid assembly for a beverage container, comprising: a lid cover having a first latch member; a lid base having a first mating member; a twist ring rotationally secured to the lid base, the twist ring having a second latch member that mates with the first latch member, the twist ring further having a second mating member that mates with the first mating member to allow the twist ring to rotate with respect to the lid base; and, a damping member between a portion of the lid base and the twist ring, the damping member adapted to stop rotation of the twist ring and to bias the twist ring toward a normal position where the first latch member is capable of mating with the second latch member.

The disclosed subject technology further relates to a lid assembly for a beverage container, comprising: a lid cover having a first latch member; a lid base having a first mating member; and, a twist ring rotationally secured to the lid base, the twist ring having a second latch member that mates with the first latch member, the twist ring further having a second mating member that mates with the first mating member to allow the twist ring to rotate with respect to the lid base.

The disclosed subject technology further relates to a lid assembly, wherein the second latch member and second mating member of the twist ring are provided on an interior surface of the twist ring, and wherein the twist ring has an external knob to allow a user to rotate the twist ring.

The disclosed subject technology further relates to a lid assembly, wherein the twist ring has a normal position and an unlatch position. In one embodiment, in the normal position the second latch member engages the first latch member, and in the unlatch position the first latch member is disengaged from the second latch member.

The disclosed subject technology further relates to a lid assembly, wherein the twist ring has a stop on an interior surface that engages the damping member.

The disclosed subject technology further relates to a lid assembly, wherein the first mating member comprises one of a track and a follower, and wherein the second mating member comprises the other of the track and the follower.

The disclosed subject technology further relates to a lid assembly, wherein when the twist ring is in the normal position and the lid cover is pivoted toward to the lid base to close the lid cover, the first latch member engages the second latch member and rotationally displaces the twist ring.

The disclosed subject technology further relates to a lid assembly, further comprising a damping member between a portion of the lid base and the twist ring, the damping member adapted to stop rotation of the twist ring and to bias the twist ring toward a normal position. In another embodiment, the damping member is adapted to stop rotation of the twist ring and to bias the twist ring toward a normal position where the first latch member is capable of mating with the second latch member.

The disclosed subject technology further relates to a lid assembly, further comprising a lock operably connected to the lid base, the lock moving between a locked position and an unlocked position, the lock preventing rotation of the twist ring when the lock is in the locked position.

The disclosed subject technology further relates to a lid assembly, wherein the lid cover is pivotally connected to the lid base, wherein the lid cover pivots in a first plane, wherein the twist ring rotates in a second plane, and wherein the second plane is transverse to the first plane. In another embodiment the first plane is substantially perpendicular to the second plane.

The disclosed subject technology further relates to a lid assembly, further comprising a spout extending from the lid base, the spout having an opening providing access to a cavity of the beverage container, and the lid having a seal to close the opening of the spout when the first latch member is secured to the second latch member.

It is understood that other configurations and embodiments of the subject technology will become readily apparent to those skilled in the art from the following detailed description, wherein various configurations of the subject technology are shown and described by way of illustration. As will be realized, the subject technology is capable of other and different configurations, and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
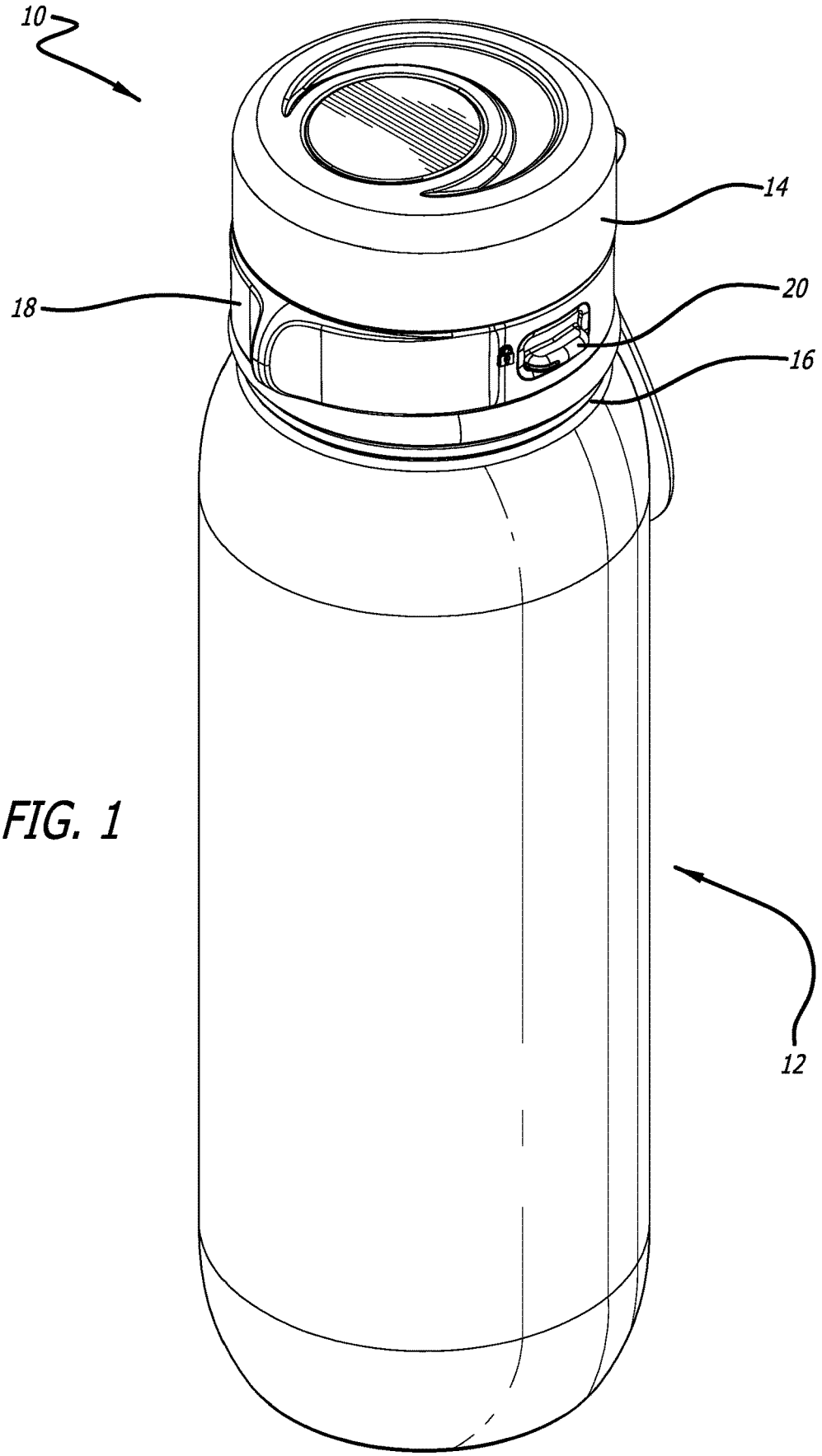
FIG. 1 illustrates a top perspective view of a beverage container having a twister unlatching mechanism according to one embodiment.
Figure 2:
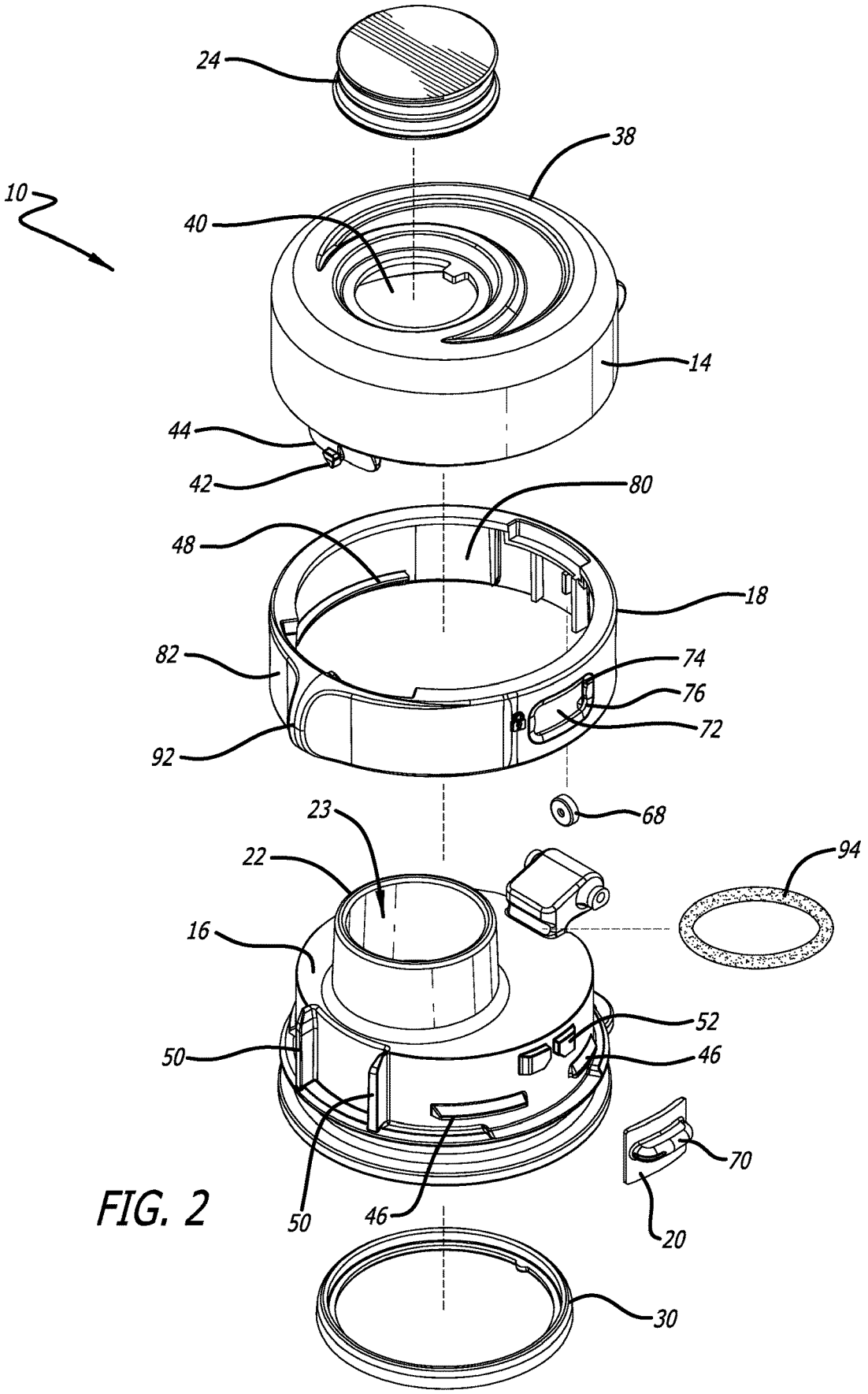
FIG. 2 illustrates an exploded perspective view of the lid of FIG. 1.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While the beverage container lid discussed herein is susceptible of embodiments in many different forms, there is shown in the drawings, and will herein be described in detail, preferred embodiments with the understanding that the present description is to be considered as an exemplification of the principles of the wagon and foldable trailer and are not intended to limit the broad aspects of the disclosure to the embodiments illustrated. Thus, the detailed description set forth below is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Referring now to the figures, and initially to FIGS. 1-5, a lid assembly 10 for a beverage container 12 is illustrated. In various embodiments, the lid assembly 10 comprises a lid cover 14, a lid base 16, and a twist ring 18. Additionally, the lid assembly 10 may also have a lock 20, a spout 22, a drink opening 23 and a spout seal 24. The twist ring 18 is used to latch and unlatch the lid cover 14 for exposing the spout 22 and drink opening 23 so that the user can drink the contents within the beverage container 12 and so that the user can cover and seal the spout 22 with the lid cover 14 during periods when the user does not need to drink the contents within the beverage container 12.

Figure 5:
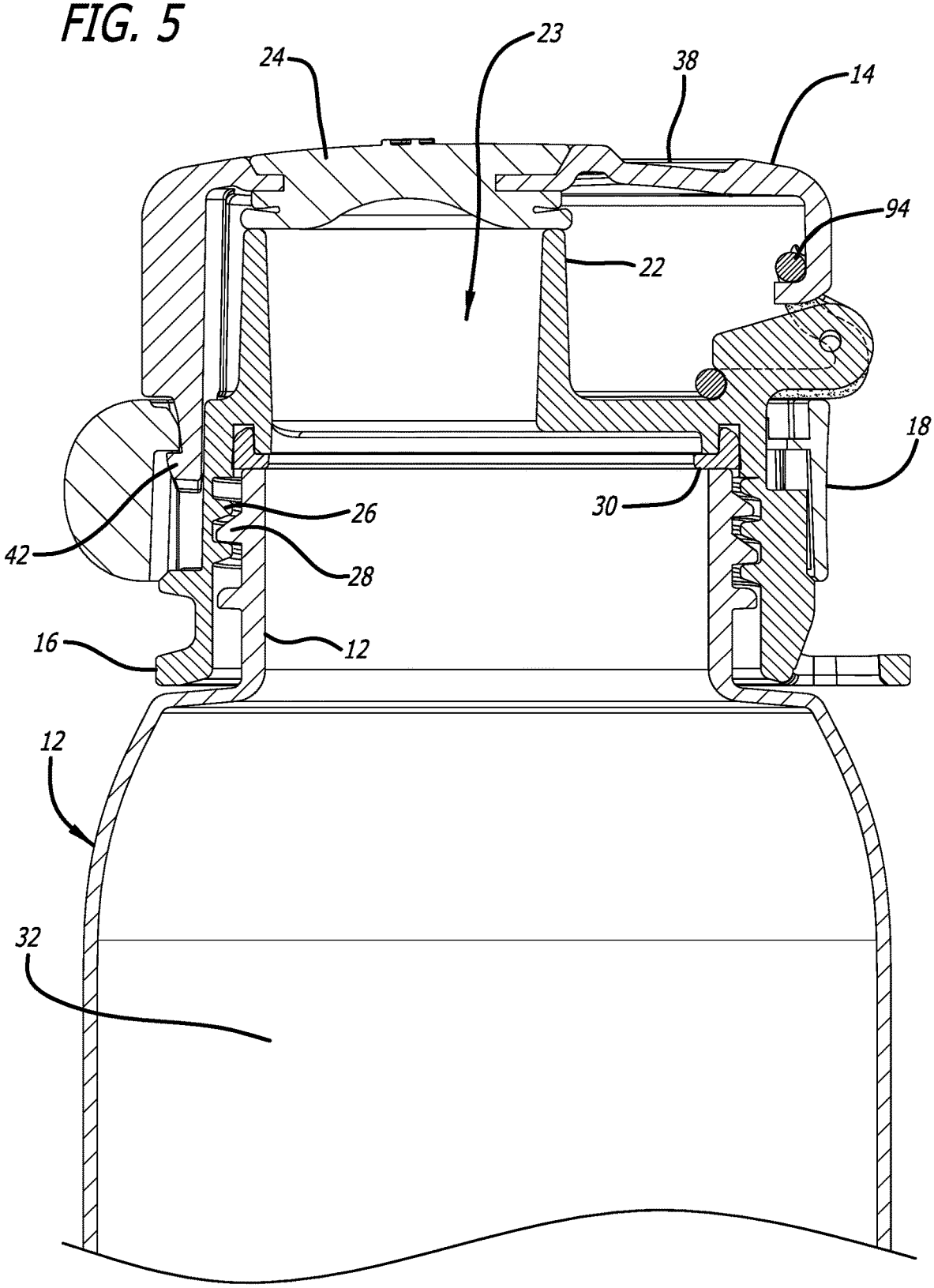
FIG. 5 illustrates a side cross-sectional view of the lid of FIG. 1.
Figure 6:
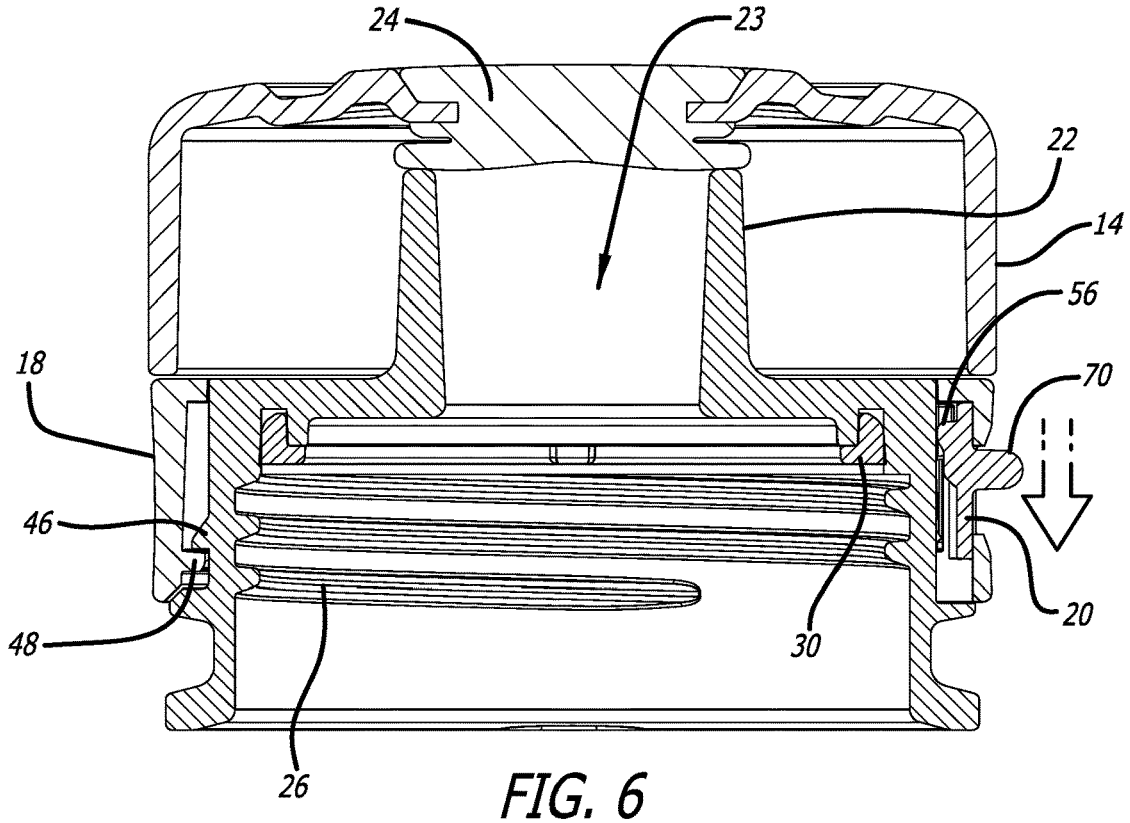
FIG. 6 illustrates a side cross-sectional view of the lid of FIG. 1, with the lock in the locked position.
Figure 7:
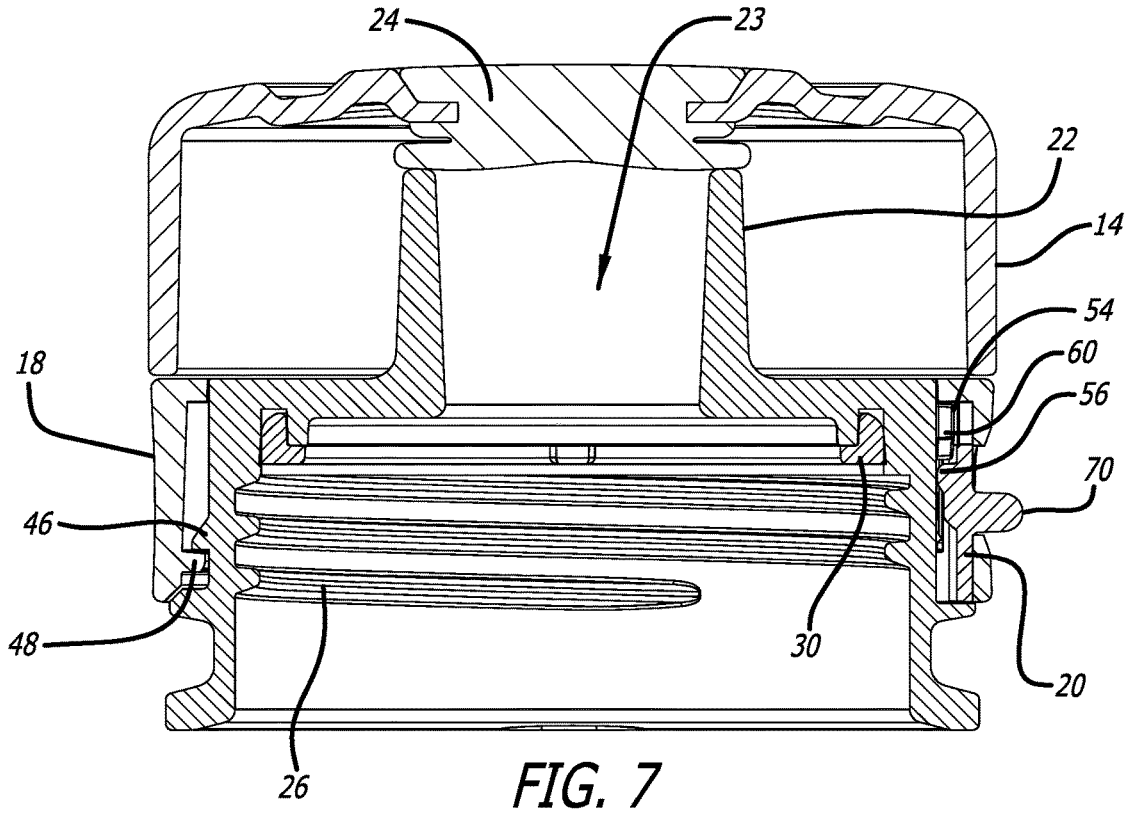
FIG. 7 illustrates a side cross-sectional view of the lid of FIG. 1, with the lock in the unlocked position.

In one embodiment the lid base 16 has threads 26, as shown in FIGS. 5-7, that engage with mating threads 28 on the inside of the beverage container 12 to secure the lid base 16 to the beverage container 12. A gasket 30 is also provided between the lid base 16 and the beverage container 12 to provide a seal between the lid base 16 and the beverage container 12 so that the contents within a cavity 32 of the beverage container 12 do not leak out at the joint between the lid base 16 and the beverage container 12.

Figure 10:
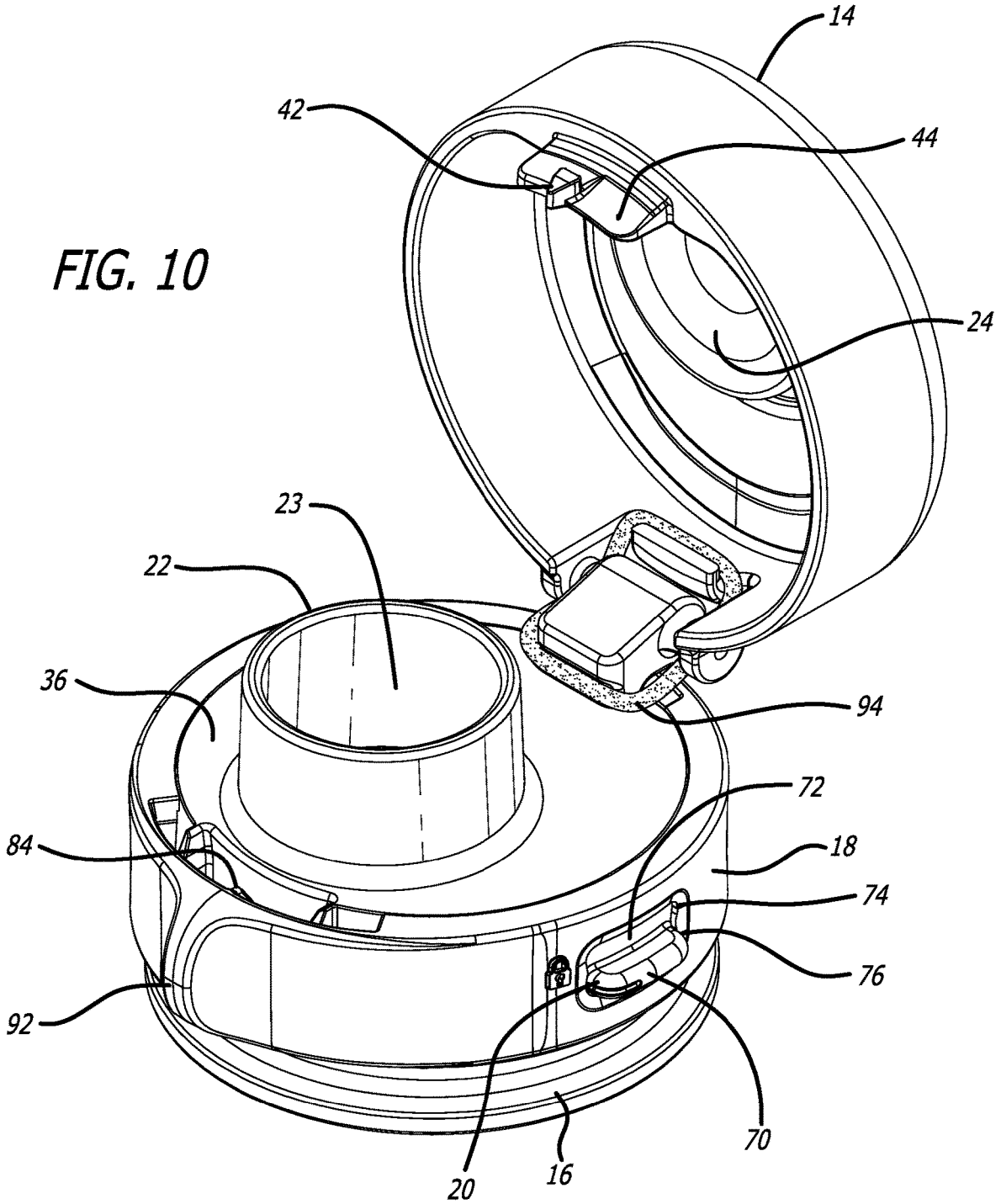
FIG. 10 illustrates a top perspective view of the lid of FIG. 1, with the lid cover in the open position.
Figure 11:
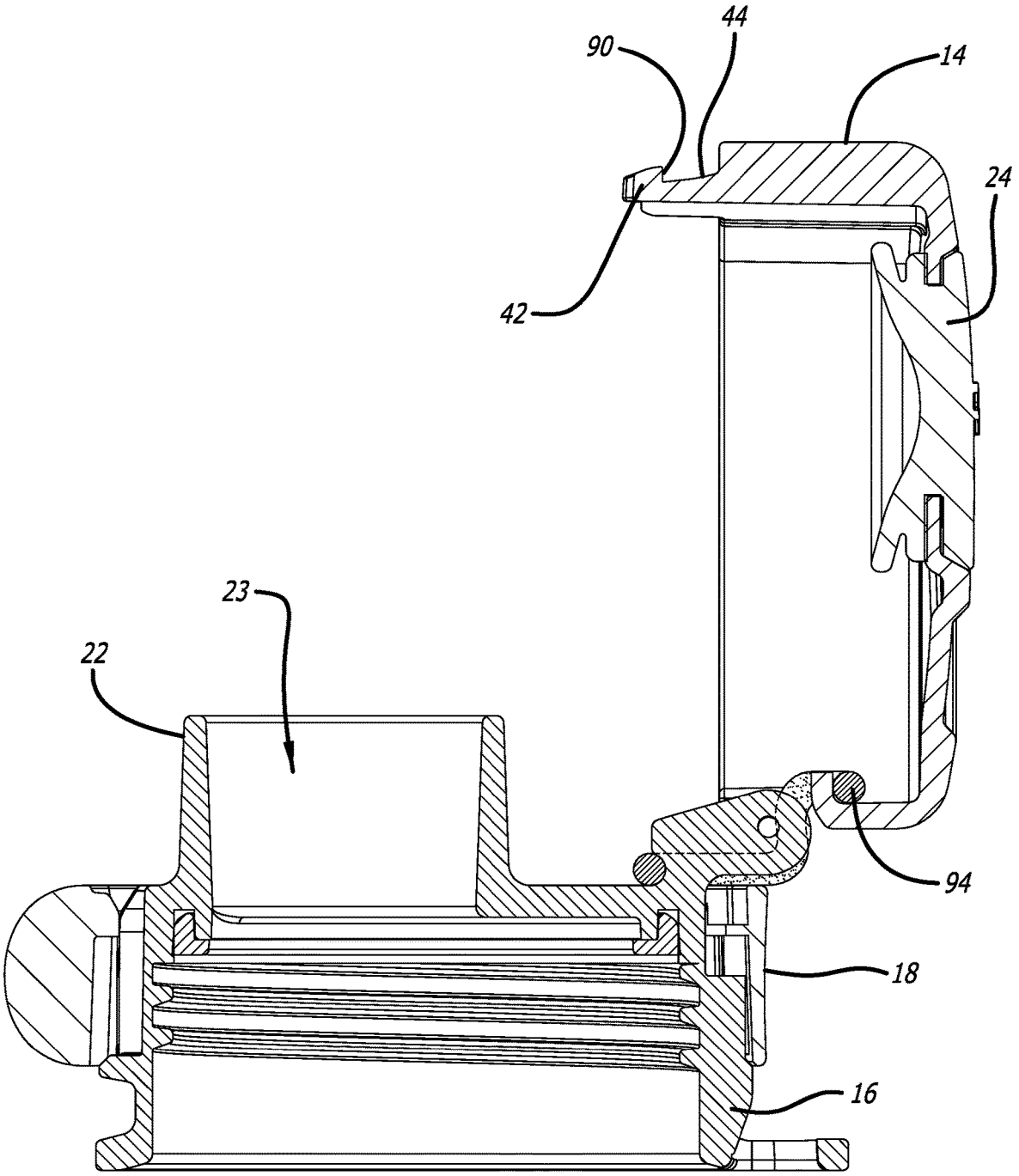
FIG. 11 illustrates a side cross sectional view of the lid of FIG. 1, with the lid cover in the open position.
Figure 12:
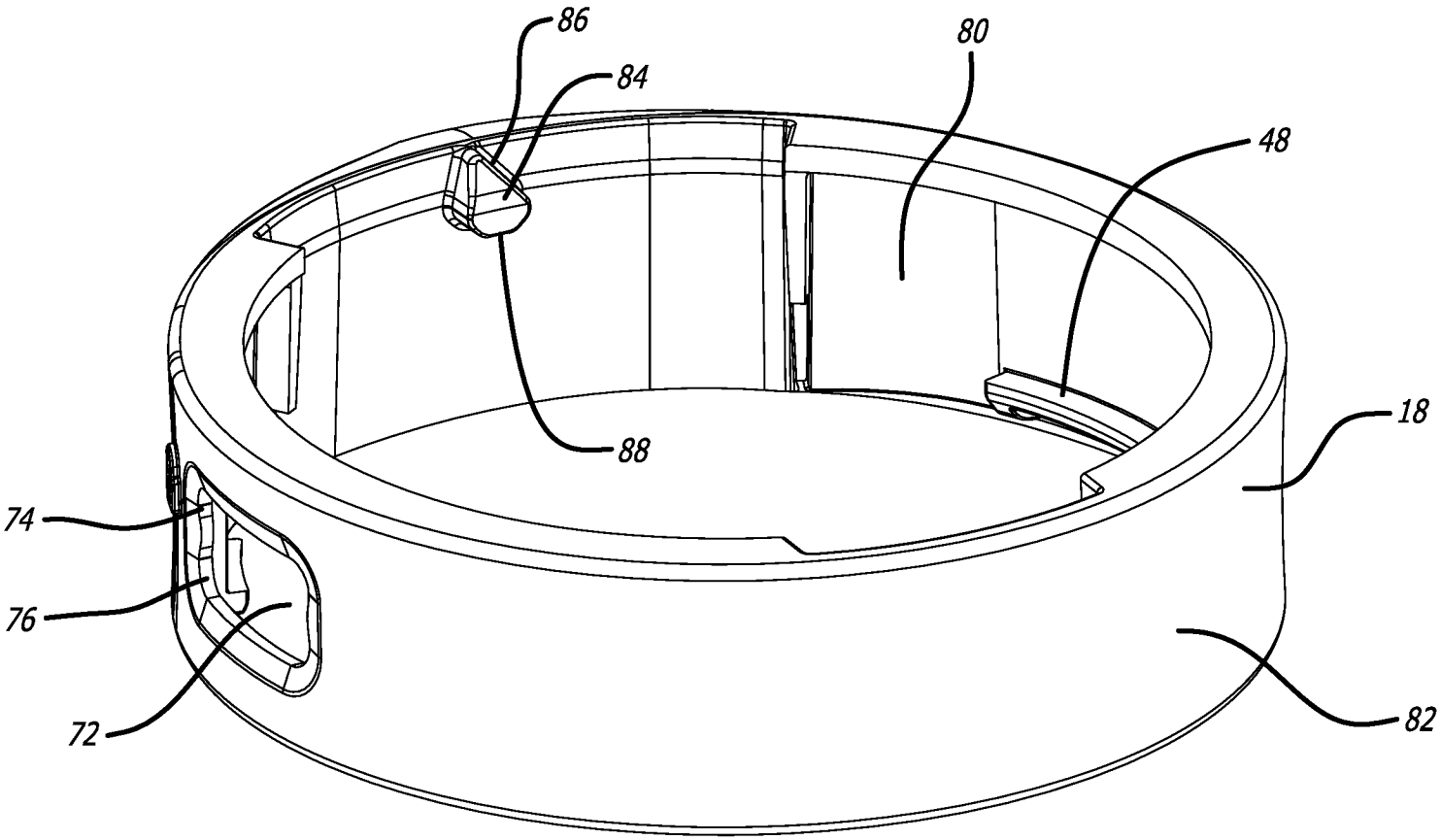
FIG. 12 illustrates a top rear perspective view of the twist ring of the lid of FIG. 1.

As shown in FIGS. 10 and 11, the lid cover 14 is pivotally connected to the lid base 16. In one embodiment, the lid cover 14 comprises a domed housing 38 to which the spout seal 24 is secured. In one embodiment, the lid cover 14 has an opening 40 in the top of the domed housing to secure the spout seal 24. The lid cover 14 also has a first latch member 42 extending therefrom. In one embodiment, the first latch member 42 extends from a downward tab 44 of the lid cover 14 at the front of the lid cover 14. In one embodiment, the first latch member 42 may be a downwardly pointing diamond or triangularly shaped protrusion, however other shapes may also be used. Additionally, the first latch member 42 may have a beveled outer surface to provide for ease of sliding against the second latch member.

Referring to FIGS. 3-5 and 10-11, the lid base 16 pivotally secures the lid cover 14. The lid base 16 has a side wall 34 and a top wall 36. In one embodiment, a drink spout 22 extends from the top wall 36 of the lid base 16, however, alternate spouts and other type of drink members may be utilized in alternate embodiments. The spout 22 of this embodiment has a drink opening 23 that leads to and provides access to the cavity 32 of the beverage container 12. When the lid cover 14 is secured to the lid base 16 in a closed position as shown in FIGS. 5-7 and 11, the first latch member 42 is secured to the second latch member 84 and the spout seal 24 operates to close and seal the drink opening 23 of the spout 22.

In one embodiment, the side wall 34 of the lid base 16 has a first mating member 46 that is used to mate with a second mating member 48 of the twist ring 18. In one embodiment the first mating member 46 of the lid base 16 is a track 46 comprised of spaced apart rails 46, and the second mating member 48 of the twist ring 18 is a follower 48, such as a protrusion 48. Alternate mating structure may be provided for the first mating member and second member, such as, but not limited to, a slot and peg, a cam and cam follower, etc.

As shown in FIGS. 2-3 and 8-9, in one embodiment, vertically extending guiderails 50 extend radially outwardly from the side wall 34 of the lid base 16. The guiderails 50 operate to guide the downward tab 44 of the lid cover 14 during closing of the lid cover 14 on the lid base 16.

Figure 3:
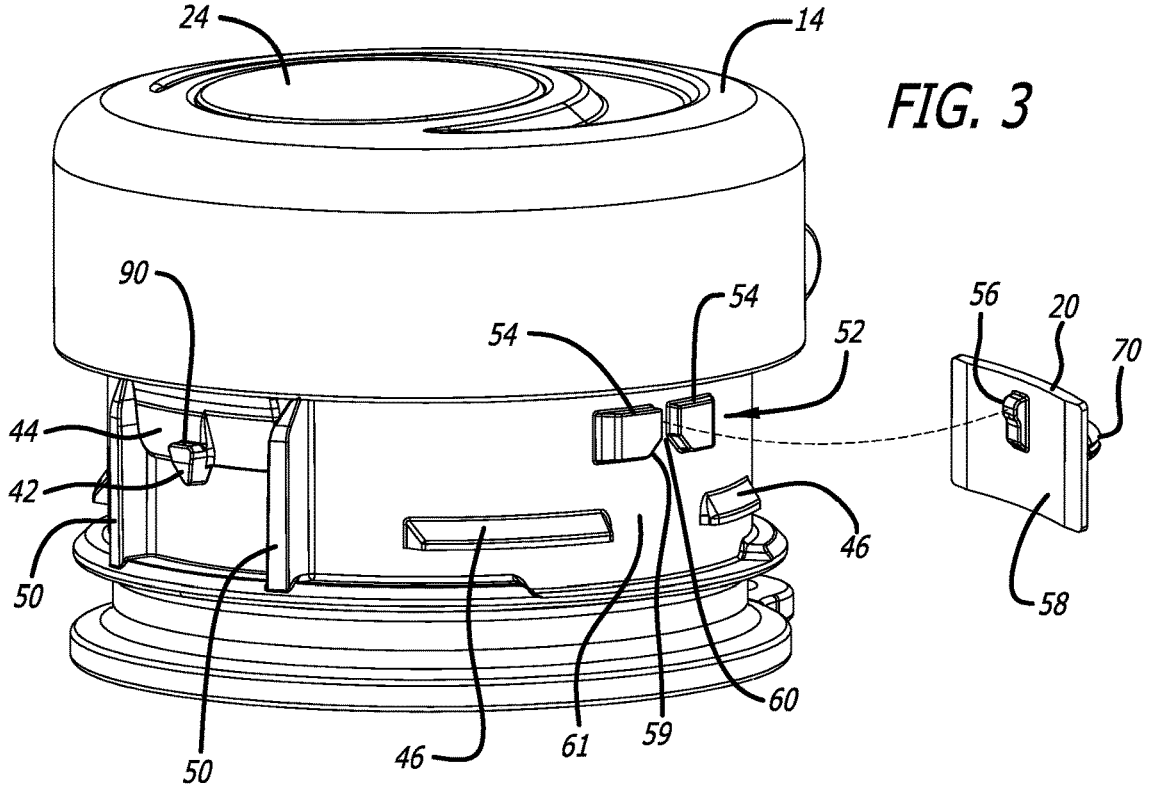
FIG. 3 illustrates a front perspective view of the lid of FIG. 1 with the twist band removed and the lock mechanism exploded off the lid.
Figure 4:
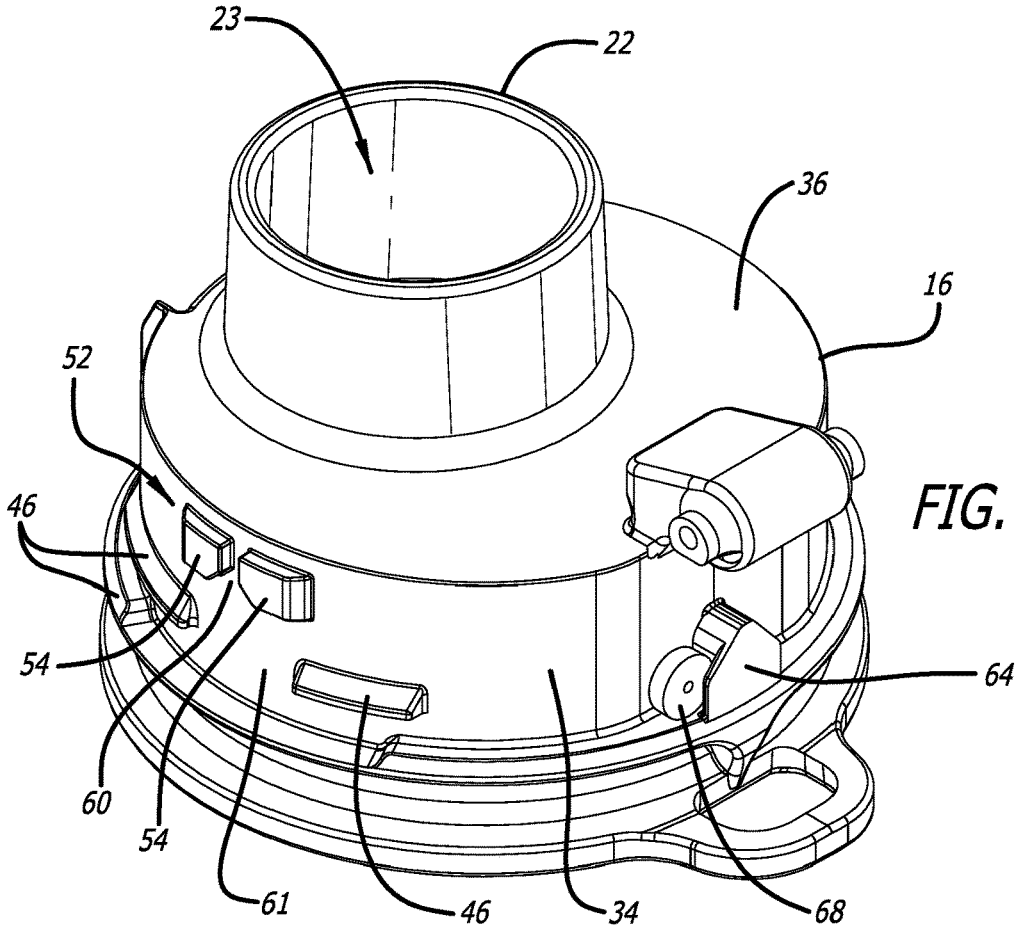
FIG. 4 illustrates a front perspective view of the lid of FIG. 1 with the lid cover and twist band removed.

In one embodiment, the lid base 16 also has a receiver 52 for the lock 20. Referring to FIGS. 3 and 4, the receiver 52 comprises opposing blocks 54 on the side wall 34 of the lid base 16 with a slot 60 therebetween. The receivers 52 mates with a protrusion 56 on the back side 58 of the lock 20. In a preferred embodiment, the receiver 52 has a chamfered lead in 59 to help ensure that the protrusion 56 of the lock 20 can be inserted into the slot 60 of the receiver 52. Additionally, in one embodiment as shown in FIGS. 3 and 4, the first mating member 46 of the lid base 16 may have a relief 61 to allow the lock 20 to slide vertically on the side wall 34 of the lid base 16. As explained in detail herein, the lock 20 is operably connected to the lid base 16 and moves between a locked position as shown in FIG. 6, and an unlocked position as shown in FIG. 7. The lock 20 also has a flange 70 extending from a front wall that extends through an opening 72 in the twist ring 18. The opening 72 in the twist ring 18 has two positions for the flange 70 of the lock 20, a locked position 74 and an unlocked position 76. The user is able to move the flange 70 between the locked position and the unlocked position when the twist ring 18 is in its normal position as explained herein. When the lock 20 is in the locked position the protrusion 56 of the lock 20 is secured within the slot 60 of the lock receiver 52 and the lock receiver 62 prevents the lock 20 and the twist ring 18 from arcuate sliding or rotating along the side wall 34 of the lid base 16. Conversely, when the lock 20 is in the unlocked position the protrusion 56 of the lock 20 is not retained within the slot 60 of the lock receiver 52, but rather is below the receiver 52, and thus the lock receiver 62 does not prevent the lock 20 or twist ring 18 from arcuate sliding along the side wall 34 of the lid base 16. The lock 20 thus prevents rotation of the twist ring 18 when the lock 20 is in the locked position of FIG. 6.

Figure 8:
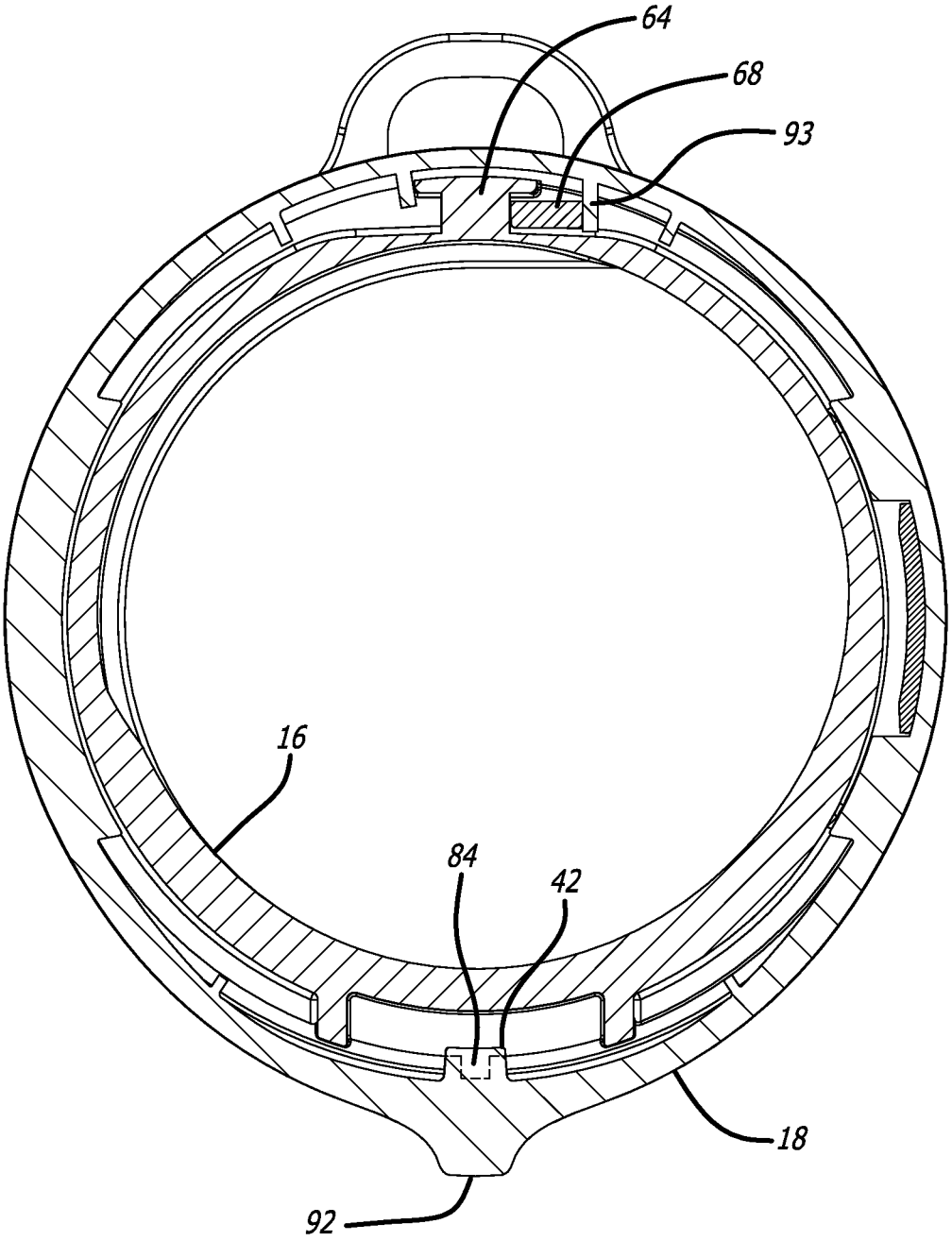
FIG. 8 illustrates a top cross-sectional view of the lid of FIG. 1, with the twist ring in the latched position.
Figure 15:
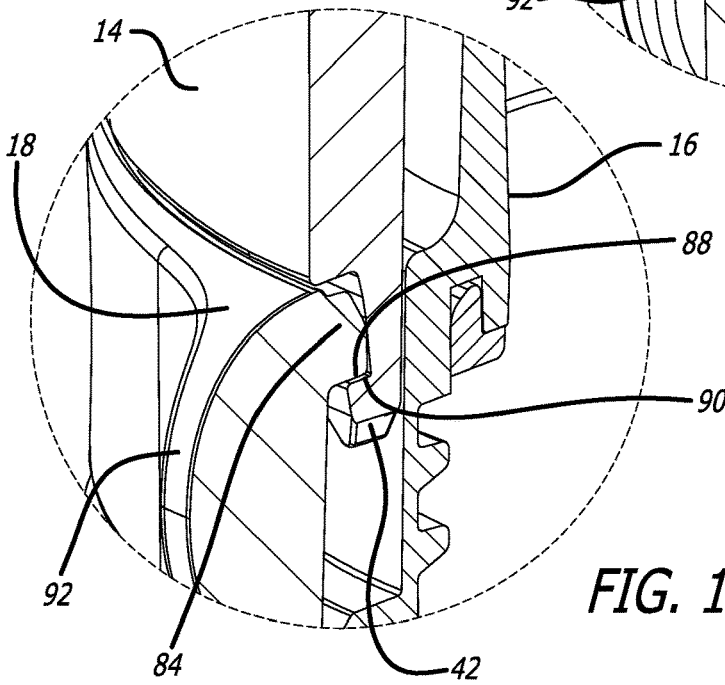
FIG. 15 illustrates a partial cross-sectional perspective view of the latch mechanism of the lid of FIG. 1, in the latched position.

Referring to the rear of the lid base 16, in one embodiment a stop 64 extends from the side wall 34 of the lid base 16. The stop 64 assists to receive a damping member 68 for the lid assembly 10. The damping member 68 is provided between a portion of the lid base 16 and the twist ring 18 and is adapted to stop rotation of the twist ring 18 during opening of the lid cover 14 and to bias the twist ring 18 in an opposite direction of the rotation used for opening the lid cover 14. Further, the damping member 68 is used to bias the twist ring 18 to its normal position, that being the position of the twist ring 18 when the lid cover 14 is in its closed position as shown in FIGS. 1, 8 and 15, and the position of the twist ring 18 when the lid cover 14 is open such as shown in FIGS. 10 and 11, so that the first latch member 42 of the lid cover 14 is capable of mating with the second latch member 84 of the twist ring 18. In one embodiment, the damping member 68 is a member that has spring like properties, and preferable elastic properties as well. The damping member 68 may be a traditional spring, however, in a preferred embodiment it is a polymeric component that absorbs a force and provides a return resistance or bias force.

The twist ring 18 is rotationally connected around a portion of the lid base 16. In one embodiment, the twist ring 18 is used to latch and unlatch the lid cover 14 for exposing the spout 22 and drink opening 23 so that the user can drink the contents within the beverage container 12 and so that the user can cover and seal the spout 22 with the lid cover 14 during periods when the user does not need to drink the contents within the beverage container 12. As shown in FIGS. 1, 2, 6-10, 12 and 13-15, the twist ring 18 has a ring-like shape. Thus, the twist ring 18 has an interior surface 80 and an exterior surface 82. As explained herein, the twist ring 18 has a second mating member 48, such as a follower or protrusion, extending from the interior surface 80 that mates with the first mating member 46 on the side wall 34 of the lid base 16. The interaction of the first and second mating members 46, 48 allow the twist ring 18 to be rotationally and axially secured to the lid base 16, and allow the twist ring 18 to rotate with respect to the lid base 16 and the lid cover 14.

In one embodiment, as best shown in FIGS. 12-15, the twist ring 18 also has a second latch member 84 that mates with the first latch member 42 of the lid cover 14. In one embodiment, the second latch member 84 is provided on and extends from the interior surface 80 of the twist ring 18. In one embodiment the second latch member 84 is an upwardly pointing diamond or triangularly shaped protrusion 84, and in a preferred embodiment it has a beveled outer surface to provide for each of engagement with the first latch member 42. Additionally, in one embodiment the engaging side 86 of the second latch member 84 may have a slight curve thereto to also provide for ease of engagement with the first latch member 42. The bottom surface 88 of the second latch member 84 may have a flat portion in a preferred embodiment, and the top surface 90 of the first latch member 42 may similarly have a flat portion in a preferred embodiment, however it is not necessary, so that the bottom surface 88 of the second latch member 84 can lock against the top surface 90 of the first latch member 42 to retain the lid cover 14 secured to the twist member 18 and lid base 16.

Referring to FIGS. 1, 2 and 8-15, the twist ring 18 has an external knob 92 extending from the exterior surface 82 thereof. The external knob 92 is provided to allow a user to exert a force on the twist ring 18 to rotate the twist ring 18 with respect to the lid base 16 and lid cover 14 for opening the lid cover 14.

Figure 9:
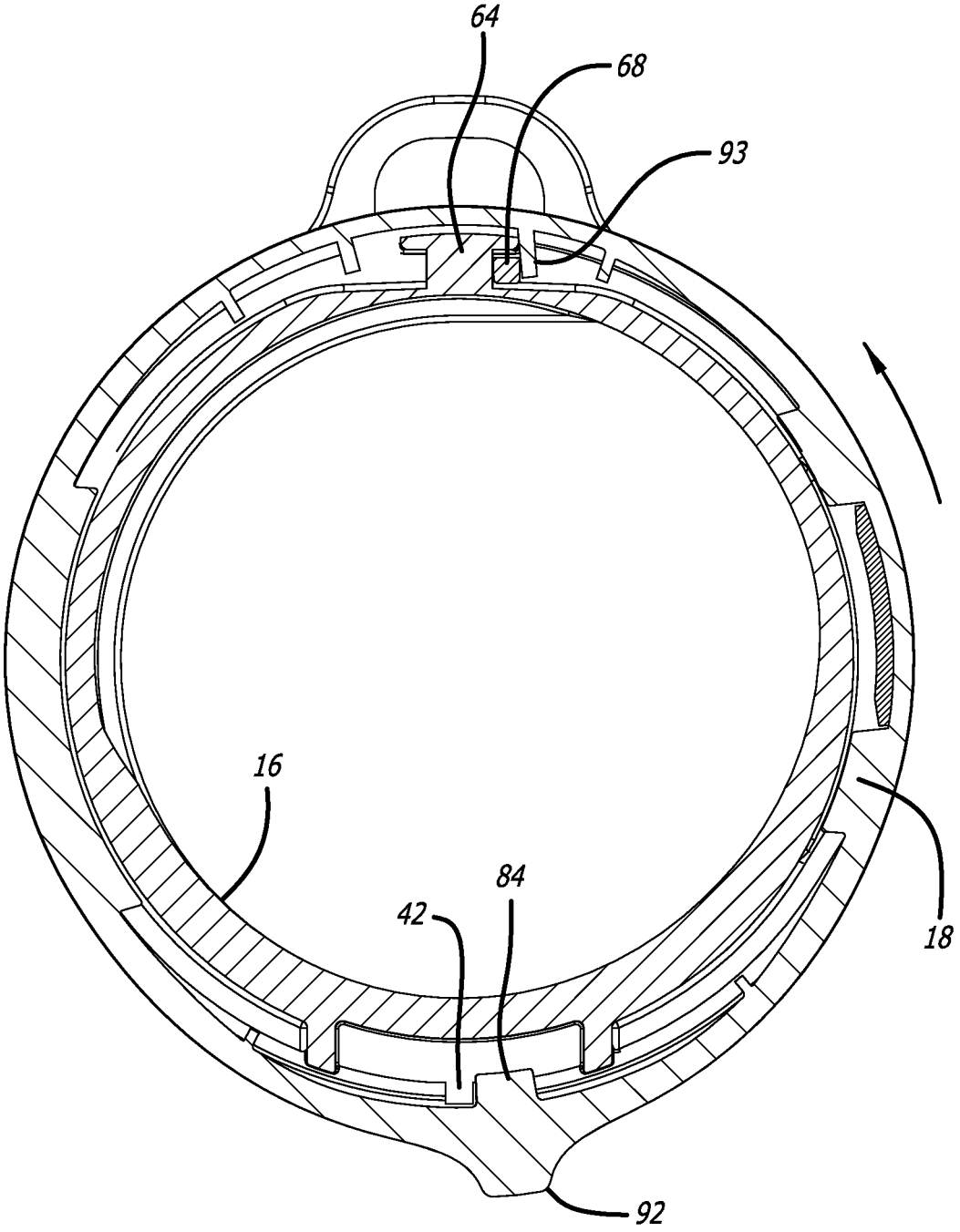
FIG. 9 illustrates a top cross-sectional view of the lid of FIG. 1, with the twist ring in the unlatched position.

As shown in FIGS. 1, 5, 8 and 15, the twist ring 18 is typically orientated in its normal position. The normal position is a position where the second latch member 84 of the twist ring 18 is ready to engage the first latch member 42 of the lid cover 14 to secure the lid cover 14 to the lid base 16 and twist ring 18. In one embodiment, as shown in FIGS. 8 and 9, the twist ring 18 also has a stop 93 on the interior surface 80 that is used to engage the damping member 68. As shown in FIG. 8, the damping member 68 assists in biasing the twist ring 18 to the normal position to maintain the twist ring 18 in the normal position absent any opposing force by a user on the twist ring 18. The twist ring 18 also has an unlatch position as shown in FIG. 9. To move the twist ring 18 to the unlatch position a user must first apply a force to the twist ring 18, typically on the external knob 92 of the twist ring 18, to rotate the twist ring 18 toward the rear of the lid 10. When a force is applied on the twist ring 18 to overcome the spring force of the damping member 68 the twist ring 18 will rotate to the unlatch position as shown in FIG. 9. The second latch member 84 rotates arcuately with the twist ring 18. When the twist ring 18 and second latch member 84 rotate arcuately to the unlatch position as shown in FIG. 9, the first latch member 42 is released or disengaged from the second latch member 84 and the lid cover 14 will pivot to the open position as shown in FIGS. 10 and 11 due to the lid spring 94 exerting an opening force on the lid cover 14.

Figure 13:
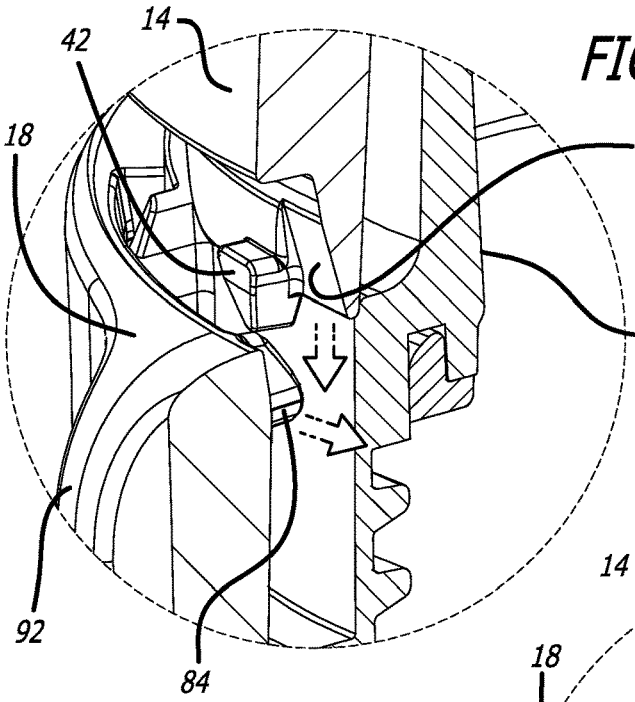
FIG. 13 illustrates a partial cross-sectional perspective view of the latch mechanism of the lid of FIG. 1, prior to latching.
Figure 14:
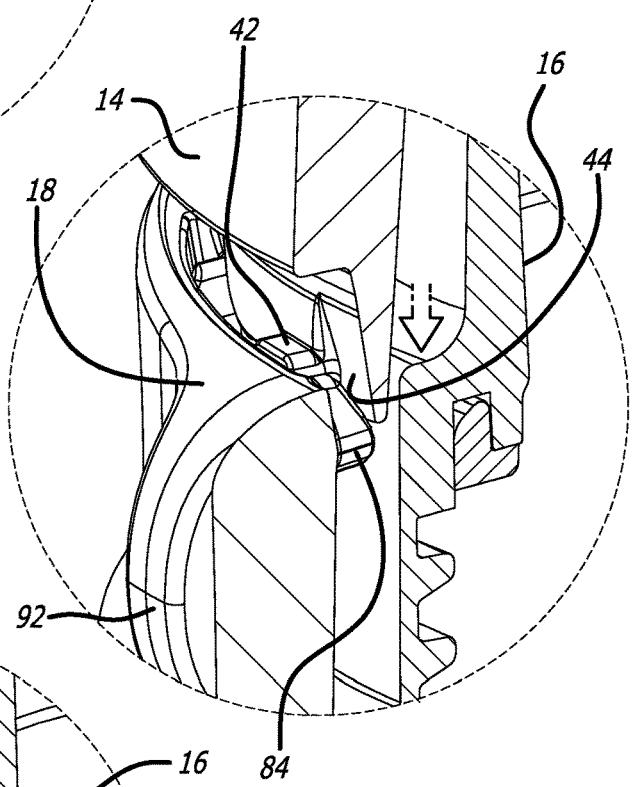
FIG. 14 illustrates a partial cross-sectional perspective view of the latch mechanism of the lid of FIG. 1, during latching.

In use, when the lid cover 14 is in the open position the drink opening 23 is accessible for the user to drink the contents of the beverage container 12 as shown in FIG. 10. Additionally, when the lid cover 14 is in the open position the twist ring 18 will be in the normal position as shown in FIGS. 8 and 10. When the user desires to close the drink opening 23 the user pivots the lid cover 14 toward the lid base 16. As the lid cover 14 gets close to the lid base 16, in one embodiment, the downward tab 44 of the lid cover 14 will engage the guiderails 50 of the lid base to guide the lid cover 14 into the proper location. As the lid cover 14 is pushed further toward the lid base 16, the first latch member 42 will begin to engage the second latch member 84 of the twist ring 18 as shown in FIG. 13. The interference between the first latch member 42 and the second latch member 84, as well as the mating geometries of the first and second latch members 42, 84, will cause the twist ring 18 to rotationally displace as shown in FIGS. 9 and 14 to the unlatch position to allow the lid cover 14 to fully close on the lid base 16. When the lid cover 14 is in the fully closed position the twist ring 18 will rotate back to its normal position as shown in FIGS. 8 and 15 due to the bias force of the damping member 68. As shown in FIG. 15, when the lid cover 14 is in the fully closed position the second latch member 84 will engage the first latch member 42 to retain the lid cover 14 in the closed position. As explained above and shown in FIG. 15, in this position the bottom surface 88 of the second latch member 84 will engage the top surface 90 of the first latch member 42 so that the bottom surface 88 of the second latch member 84 can lock against the top surface 90 of the first latch member 42 to retain the lid cover 14 secured to the twist member 18 and lid base 16. Further, in the use explanation discussed, it is clear that the lid cover 14 pivots in a first plane, and the twist ring 18 rotates in a second plane that is transverse to the first plane. In a preferred embodiment the first plane is substantially perpendicular to the second plane.

Next, if the user wants to open the lid cover 14 from the closed position, the user begins by applying a force to the external knob 92 of the twist ring 18 to rotate the twist ring 18 toward the back of the beverage container 12 as shown in FIG. 9. The user will have to overcome the spring force of the damping member 68 in order to rotate the twist ring 18 as explained above. When the twist ring 18 is rotated sufficiently to the unlatch position, the first latch member 42 will disengage from the second latch member 84 and the lid spring 94 will pivot the lid cover 14 to the open position as shown in FIG. 10. The user can remove force from the twist ring 18 and the damping member 68 will return the twist ring 18 to its normal position.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A lid assembly for a beverage container, comprising:

a lid cover having a first latch member;

a lid base pivotally securing the lid cover, the lid base having a first mating member and a drink spout;

a twist ring rotationally connected around a portion of the lid base, the twist ring having a second latch member that mates with the first latch member, the twist ring further having a second mating member that mates with the first mating member, the twist ring having an opening therethrough, wherein the twist ring is adapted to rotate with respect to the lid base and the lid cover;

a damping member between a portion of the lid base and the twist ring, the damping member adapted to stop rotation of the twist ring and to bias the twist ring in an opposite direction; and, a lock operably connected to the lid base and extending through the opening in the twist ring, the lock moving between a locked position and an unlocked position, the lock preventing rotation of the twist ring when the lock is in the locked position.

2. The lid assembly of claim 1, wherein the second latch member and second mating member of the twist ring are provided on an interior surface of the twist ring, and wherein the twist ring has an external knob to allow a user to rotate the twist ring.

3. The lid assembly of claim 1, wherein the twist ring has a normal position and an unlatch position.

4. The lid assembly of claim 3, wherein in the normal position the second latch member engages the first latch member, and wherein in the unlatch position the first latch member is disengaged from the second latch member.

5. The lid assembly of claim 1, wherein the first mating member comprises one of a track and a follower, and wherein the second mating member comprises the other of the track and the follower.

6. The lid assembly of claim 1, further comprising a spout extending from the lid base, the spout having an opening providing access to a cavity of the beverage container, and the lid having a seal to close the opening of the spout when the first latch member is secured to the second latch member.

7. A lid assembly for a beverage container, comprising:

a lid cover having a tab extending downward therefrom and a first latch member extending from the tab, the lid cover pivoting between a closed position and an open position;

a lid base having a first mating member;

a twist ring rotationally secured to the lid base, the twist ring having a second latch member that mates with the first latch member, the twist ring further having a second mating member that mates with the first mating member to allow the twist ring to rotate with respect to the lid base, wherein the lid cover sits adjacent the lid base and above the twist ring when the lid cover is in the closed position, and wherein in the closed position the tab extends below a top surface of the twist ring to allow the first latch member to engage the second latch member; and, a damping member between a portion of the lid base and the twist ring, the damping member adapted to stop rotation of the twist ring and to bias the twist ring toward a normal position where the first latch member is capable of mating with the second latch member.

8. The lid assembly of claim 7, further comprising a lock operably connected to the lid base, the lock moving between a locked position and an unlocked position, the lock preventing rotation of the twist ring when the lock is in the locked position.

9. The lid assembly of claim 8, wherein the twist ring has an opening therethrough, and wherein the lock extends through the opening in the twist ring.

10. The lid assembly of claim 7, wherein the lid base has a drink spout.

11. The lid assembly of claim 10, wherein the lid cover has a seal for the spout.

12. A lid assembly for a beverage container, comprising:

a lid cover having a first latch member extending therefrom;

a lid base having a first mating member; and, a twist ring rotationally secured to the lid base, the twist ring having a second latch member that mates with the first latch member, the twist ring further having a second mating member that mates with the first mating member to allow the twist ring to rotate with respect to the lid base, wherein the lid cover sits adjacent the lid base and above the twist ring when the lid cover is in a closed position, and wherein in the closed position the first latch member extends below a top surface of the twist ring to engage the second latch member.

13. The lid assembly of claim 12, further comprising a lock operably connected to the lid base and extending through an opening in the twist ring, the lock moving between a locked position and an unlocked position, the lock preventing rotation of the twist ring when the lock is in the locked position.

14. The lid assembly of claim 12, further comprising a damping member between a portion of the lid base and the twist ring, the damping member adapted to stop rotation of the twist ring and to bias the twist ring toward a normal position where the first latch member is capable of mating with the second latch member.

15. The lid assembly of claim 14, wherein the twist ring has a stop on an interior surface that engages the damping member.

16. The lid assembly of claim 12, wherein the twist ring has a normal position and an unlatch position, wherein in the normal position the second latch member can engage the first latch member, and wherein in the unlatch position the first latch member is disengaged from the second latch member.

17. The lid assembly of claim 16, wherein when the twist ring is in the normal position and the lid cover is pivoted toward to the lid base to close the lid cover, the first latch member engages the second latch member and rotationally displaces the twist ring.

18. The lid assembly of claim 12, wherein the lid cover is pivotally connected to the lid base, wherein the lid cover pivots in a first plane, wherein the twist ring rotates in a second plane, and wherein the second plane is transverse to the first plane.

19. The lid assembly of claim 18, wherein the first plane is substantially perpendicular to the second plane.

20. The lid assembly of claim 12, wherein the first mating member comprises one of a track and a follower, and wherein the second mating member comprises the other of the track and the follower.

* * * * *